US005957349A

United States Patent [19]

Krulik

[11] Patent Number: 5,957,349

[45] **Date of Patent: *Sep. 28, 1999**

[54] LUGGAGE WITH SEAT

[75] Inventor: Richard J. Krulik, Dix Hills, N.Y.

[73] Assignee: United States Luggage, L.P., Hauppauge, N.Y.

[ * ] Notice: This patent is subject to a terminal disclaimer.

[21] Appl. No.: 09/078,176

[22] Filed: May 13, 1998

Related U.S. Application Data

[63] Continuation-in-part of application No. 08/841,253, Apr. 29, 1997, Pat. No. 5,779,112.

[51] Int. Cl.[6] ..... A45F 4/02

[52] U.S. Cl. ..... 224/155; 224/650; 224/653; 224/655; 224/901.8; 297/129; 297/43; 190/8

[58] Field of Search ..... 224/575, 153–156, 224/583, 161, 627, 645, 650, 651, 652, 653, 654, 655, 901.8; 297/129, 16.1, 43, 45, 53, 56; 190/1, 8

[56] References Cited

U.S. PATENT DOCUMENTS

| | | | |
|---|---|---|---|
| 1,549,647 | 8/1925 | Worthington . | |
| 2,375,819 | 5/1945 | Reid . | |
| 2,843,185 | 7/1958 | Clem et al. | 224/155 X |
| 2,922,465 | 1/1960 | Johansson et al. . | |
| 3,266,686 | 8/1966 | Griffith . | |
| 3,532,378 | 10/1970 | Dalia | 297/118 |
| 3,797,695 | 3/1974 | Law | 220/85 R |
| 4,003,455 | 1/1977 | Cortese | 190/8 |
| 4,062,584 | 12/1977 | Pinkham et al. | 297/193 |
| 4,191,420 | 3/1980 | Fassett et al. | 297/194 |
| 4,290,625 | 9/1981 | Barriere | 280/654 |
| 4,291,915 | 9/1981 | Cox | 297/193 |
| 4,387,924 | 6/1983 | Fernandez | 297/188 |
| 4,550,813 | 11/1985 | Browning | 190/18 A |
| 4,621,404 | 11/1986 | Browning | 29/463 |
| 4,676,548 | 6/1987 | Bradbury | 297/129 |
| 4,687,248 | 8/1987 | Ross et al. | 297/129 |
| 4,742,900 | 5/1988 | Boxhammer | 190/22 |
| 4,771,871 | 9/1988 | Lambracht | 190/1 |
| 4,773,574 | 9/1988 | Burgard | 224/155 |
| 4,824,167 | 4/1989 | King | 297/129 |
| 4,974,870 | 12/1990 | Jarke et al. | 280/643 |
| 5,105,919 | 4/1992 | Bomes et al. | 190/18 A |
| 5,230,450 | 7/1993 | Mahvi et al. | 224/155 X |
| 5,289,958 | 3/1994 | Jay | 224/155 |
| 5,303,975 | 4/1994 | Asato | 297/129 |
| 5,318,342 | 6/1994 | Hale | 297/129 |
| 5,374,073 | 12/1994 | Hung-Hsin | 280/30 |
| 5,445,301 | 8/1995 | Biedenharn, Jr. | 224/155 |
| 5,499,760 | 3/1996 | Pielocik | 224/155 |
| 5,533,654 | 7/1996 | Holty et al. | 224/155 |
| 5,570,829 | 11/1996 | Harrison | 224/651 |
| 5,573,155 | 11/1996 | Sadler | 224/155 |
| 5,588,570 | 12/1996 | Zirbel | 224/155 |
| 5,779,112 | 7/1998 | Krulik | 224/155 |

FOREIGN PATENT DOCUMENTS

| | | | |
|---|---|---|---|
| 2825366 A1 | 12/1979 | Germany . | |
| 638848 | 6/1950 | United Kingdom | 190/8 |
| 1194851 | 6/1970 | United Kingdom . | |

*Primary Examiner*—Gregory M. Vidovich
*Attorney, Agent, or Firm*—Abelman, Frayne & Schwab

[57] ABSTRACT

A combination article of luggage seat unit is disclosed, in which the seat unit may be completely separated from the luggage when it is desired to use the seat and when in its storage condition is compactly contained within an auxiliary compartment of the article of luggage. The seat unit may also be used while it is connected to the luggage, with a portion of the luggage re-positioned to provide a cushion of for the seat, and is secured to a planar support member for the emplacement of the seat unit within the article of luggage.

16 Claims, 9 Drawing Sheets

FIG. 1
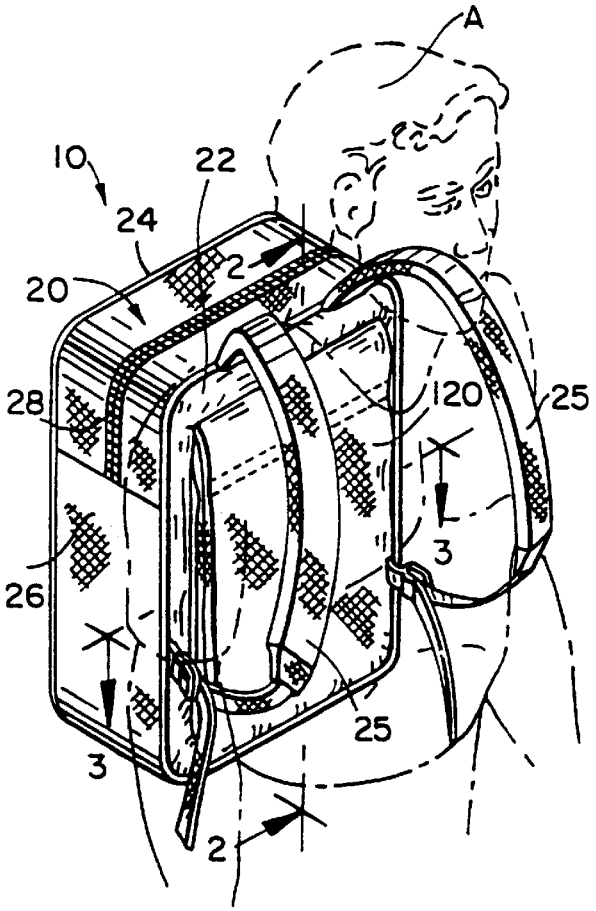
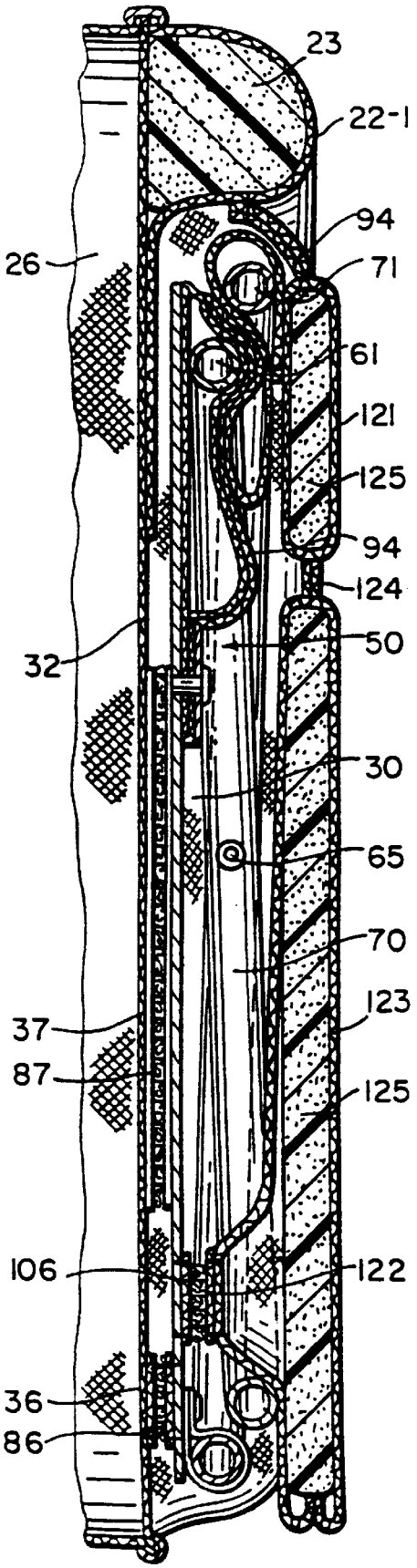
FIG. 2

122
120
123
25
124
20
25
32
121
22-3
d
28
50
38
70
30
36
94
110
24
22-2
37
l
l'
65
108
d'
w'
110
90
100
65
106
60
w 122
120
123
25
124
20
32
25
22-3
121
100
8
80
50
92
108
103
61
94
91
65
90
106
60
95
65
71
24
102
1'
72
103
62
104
70
22-2

FIG. 10
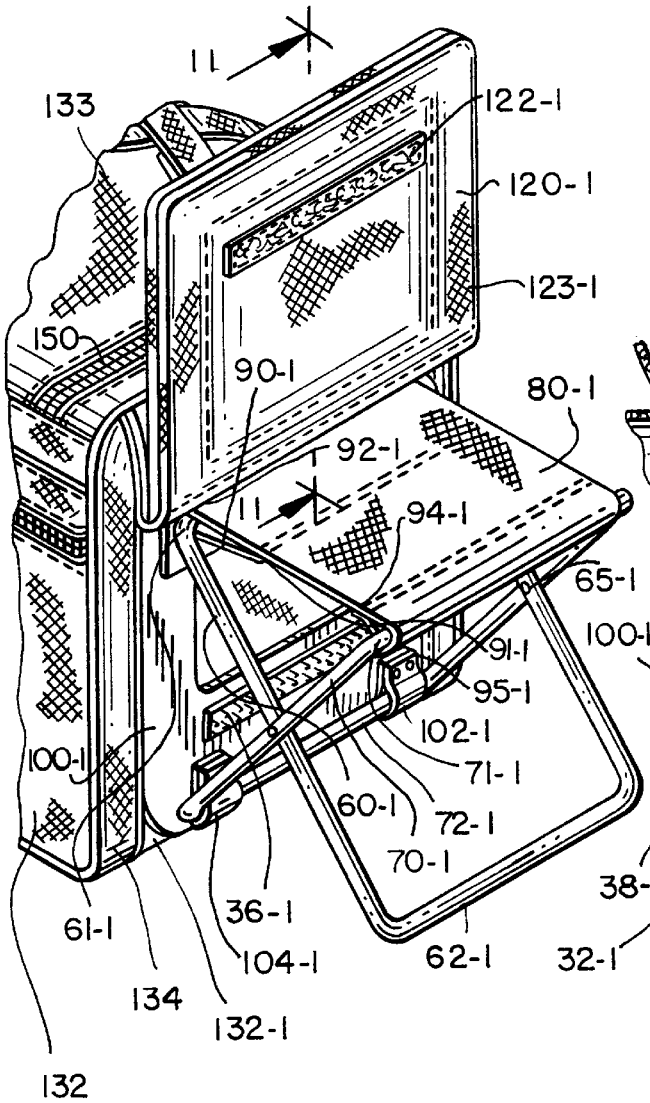
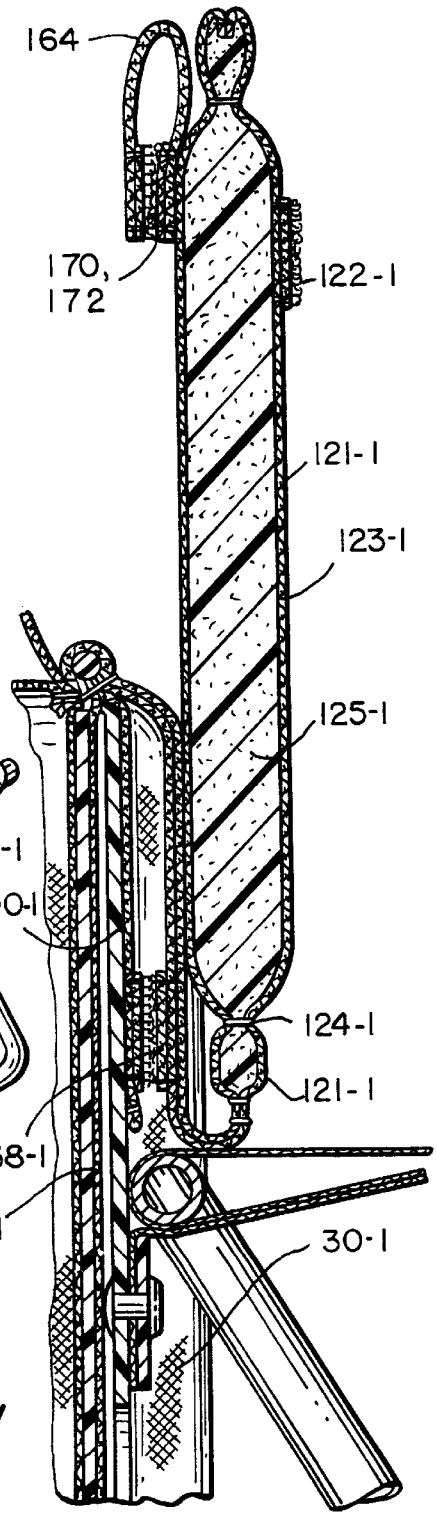
FIG. 11

LUGGAGE WITH SEAT

RELATED APPLICATIONS

This is a continuation-in-part of U.S. patent application Ser. No. 08/841,253, filed on Apr. 29, 1997, which has matured into U.S. Pat. No. 5,779,112.

FIELD OF THE INVENTION

The present invention relates to an article of luggage and seat. The article of luggage may be a backpack, duffle bag, or suitcase. If desired, the seat portion may be completely separated from the article of luggage. The seat portion, when it is in its collapsed condition is releasably inserted within an auxiliary compartment provided within an exterior wall of the luggage. When it is desired to utilize the seat, it may be completely removed from the article of luggage, and its legs pivoted open to provide the requisite seating platform for the user. Alternatively, the seat may remain connected to the article of luggage with an exterior portion of the auxiliary compartment moving over the seat to provide cushioning for user comfort.

BACKGROUND OF THE INVENTION

Luggage is commonly used for conveniently carrying a substantial variety of articles intended for numerous travel related and daily activities. Oftentimes the user of the luggage may wish to temporarily rest at a location that does not include a seat or other appropriate resting spot. Accordingly, it has been recognized that it would be advantageous to provide such a seat in conjunction with the article of luggage which would readily permit the user to open the seat and rest for the desired period of time.

While several such arrangements have been previously proposed to generally provide such a seat in conjunction with various articles of luggage, they have several disadvantages. One such disadvantage, prevalent in numerous of the prior proposals, is the requirement that the seat member be permanently attached to the article of luggage. This restricts the flexibility of seat utilization, and requires the user to tote the seat portion during those excursions when the user has no intent to utilize the seat. Hence, the user is required to always carry the extra weight and bulk of the seat. Such combinations in which the seat sections are permanently connected to the luggage are typically shown in U.S. Pat. Nos. 1,549,647; 4,003,455; 5,499,760; 5,445,301; 5,533,654; 5,318,342; 5,303,975; 4,773,574; 4,676,548; 4,550,813; 4,387,924; and 3,532,378. Further, the permanent interconnection of the luggage and seat, as typically shown in these prior structures, restricts the matter in which the seat can be used, and, in many instances provides complex and cumbersome arrangements.

Recognizing the desirability of providing increased independence between the luggage and the seat unit, while still permitting easy transporting of the seat unit within the luggage, one aspect of the present invention is to permit seat removal to substantially enhance the versatility and simplification of a combination backpack and seat unit.

One prior arrangement known to separate the seat is shown in U.S. Pat. No. 5,573,155. However it does not offer the several advantages of the present invention. For example, should it be desired to maintain the connection of the seat to the luggage, the present invention repositions a cushioned surface of the luggage to cushion the seat when the seat unit is in its operative condition.

SUMMARY OF THE INVENTION

The present invention provides a seat unit in combination with an article of luggage in which the seat unit is stored within an auxiliary luggage compartment and may advantageously be separated from the article of luggage. The article of luggage includes an auxiliary compartment into which the seat unit, which can be compactly collapsed, is inserted and releasably contained therein. Complementary Velcro hook and loop pressure sensitive fastening elements, or other attachment members on the seat unit and within the auxiliary compartment may be utilized for retaining the seat unit within the auxiliary compartment. Various articles of luggage may incorporate the seat unit of the present invention. The aforementioned U.S. patent application Ser. No. 08/841,253 discloses the combination of the seat unit within a backpack. That arrangement has been found particularly advantageous to provide the auxiliary compartment along the rear wall of the backpack unit which is intended to lie against the user's back. A cushioned panel is preferably provided to overlie the seat unit when it is inserted within the auxiliary compartment, so as to avoid any discomfort to the user resulting from the rigid components of the seat unit. This cushioned panel is advantageously constructed to overlie the seating platform of the seat unit should it be desired to utilize the seat unit while it is still connected to the backpack.

Alternatively, the seat unit may be incorporated within a variety of other forms of luggage, such as a duffle bag or conventional suitcase. When incorporating it in conjunction with a duffle bag, the auxiliary compartment which is configured to hold the seat unit may advantageously form one of the end walls of the duffle bag. When incorporated within a conventional type of suitcase, the auxiliary compartment for the seat unit may typically be located along the front or rear wall of the suitcase. It should however be understood that all locations may be selected for the retention of the seat unit, in accordance with the configuration of the particular article of luggage.

Although a variety of seat units may be utilized and appropriately configured to fit within the auxiliary compartment, the present invention shows a particularly advantageous seat unit. The seat unit is formed of a pair of tubular rectangular leg members which are pivotally connected at their mid sections. A flexible seat is connected to the upper ends of the leg members. The leg members can be moved between a first operative condition and a second storage position.

The first operative position is characterized with the leg members being pivotally opened to separate their upper and lower ends in respective spaced horizontal relationship, with the flexible seat spanning and being maintained taut, between the upper ends of the legs, and the separated lower ends of the legs adapted to engage the ground, or other support, surface.

The second storage condition is characterized with the leg members being pivoted closed to a nested flat condition, with the leg members lying substantially in the same plane, and the flexible seat being loosely contained in that plane, such that the entire seat unit is compactly folded into a planar assembly. The seat unit, when in its collapsed condition is sized to snugly fit within the auxiliary compartment provided within the article of luggage.

Accordingly, it should be appreciated that when it is desired to utilize the seat, the cushioned panel is opened to reveal the seat unit, which will be in its collapsed condition. The seat unit may then be removed from the auxiliary compartment, and thereafter the legs pivotally opened so that the seat will then be in its operative first condition. By completely separating the seat unit from the article of luggage, substantial versatility is provided as to just where the user may wish to locate the seat, without any constraints being imposed by a permanent association with the article of luggage. Alternatively, the seat unit may be moved to its operative first condition while it is still connected to the opened auxiliary compartment, with the cushioned panel then overlying the flexible seat.

Further in those situations where the article of luggage is to be used when the user has no intent of requiring a seat, the seat unit may be removed and left at the user's home or other permanent location, so as not to necessitate the carrying around of the seat unit during those periods of time when there is no intent to use the seat.

Accordingly an object of the present invention is to provide a combination article of luggage and seat unit, in which the seat unit is located within an externally accessible auxiliary compartment and may be either separated from or attached to the article of luggage during its intended utilization.

Another object of the present invention is to provide a combination article of luggage and separable seat, in which the article of luggage includes an auxiliary compartment with a cushioned external flap for compactly containing the seat unit when it is in its collapsed, storage condition.

A further object of the present invention is to provide such a combination article of luggage and separable seat assembly wherein the seat unit may be readily removed from, and reinserted within an auxiliary compartment of the article of luggage by complementary releasable means contained within the auxiliary compartment and seat unit.

Yet a further object of the present invention is to provide such a seat unit which is formed of two pivotally connected leg members, having a flexible fabric seat connected to its upper ends, with the fabric seat controlling the degree of pivotal movement between the leg members.

Yet a further object of the present invention is to provide such a seat unit which may be utilized in conjunction with various articles of luggage, such as a backpack, duffle bag, or suitcase.

These as well as other objects of the present invention win become apparent upon a review of the following drawings and detailed descriptions.

BRIEF DESCRIPTION OF THE DRAWINGS

FIG. 1 is a perspective view showing the manner in which a combination backpack seat unit of the present invention, in its fully assembled condition, is carried by the user.

FIG. 2 is a partial cross-sectional view along the line 2—2, as shown in FIG. 1, and looking in the direction of the arrows (it is noted that the shoulder strap is not shown for clarity).

FIG. 10 is a partial perspective view showing the manner in which the auxiliary compartment is open and the seat unit is in its operative condition, while still being attached to the end of the duffle bag.

FIG. 11 is a partial cross-sectional view along the line 11—11 as shown in FIG. 10 and looking in the direction of the arrows.

Figure 3:
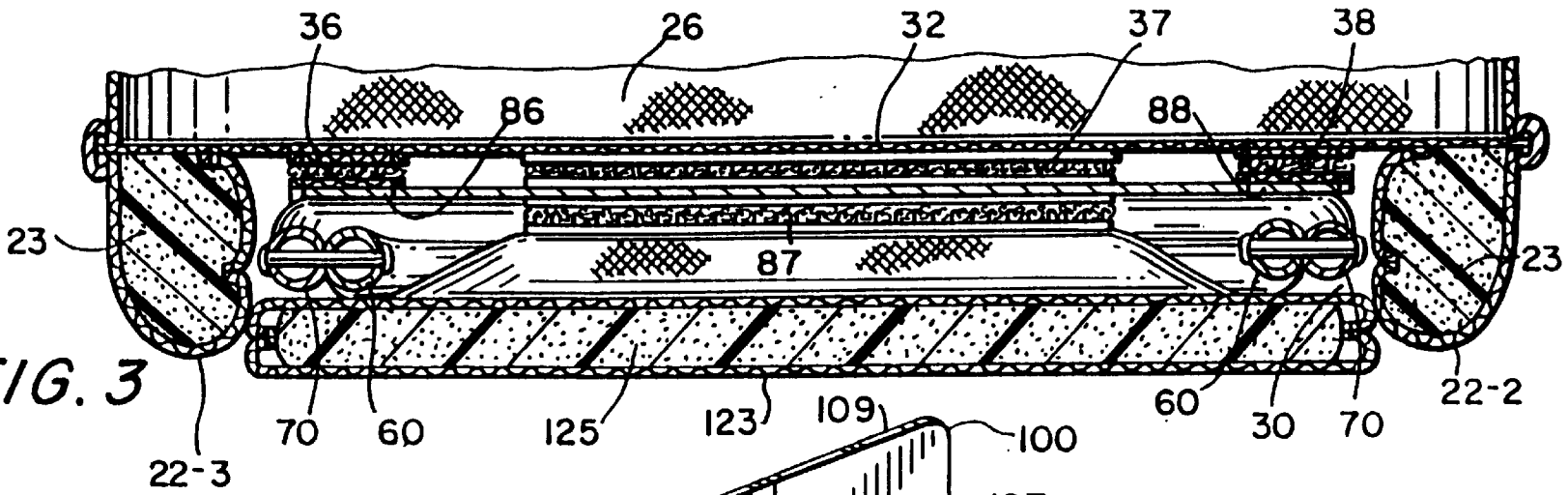
FIG. 3 is a partial cross-sectional view along the line 3—3 as shown in FIG. 1 and looking in the direction of the arrows (it is noted that the shoulder straps are not shown for clarity).

Reference is initially made to the embodiment shown in FIGS. 1–6.

FIG. 1 shows the combination backpack and separable seat assembly 10 carried on the back of the user, A, shown in phantom lines. The backpack unit 20 includes a rear wall 22, front wall 24, which define therebetween an article receiving department 26. A manually openable means 28 which may typically be a zipper, provides access to the article receiving compartment 26, as well as closing thereof. Conventional shoulder straps 25 extend outward of the rear wall 22 for positioning and maintaining the backpack unit 20 against the user's back. Backpack unit 20 may be formed of a reenforced fabric material such as canvas. It should however be appreciated that alternative materials may be utilized according to the overall requirements of the specific unit.

Figure 4:
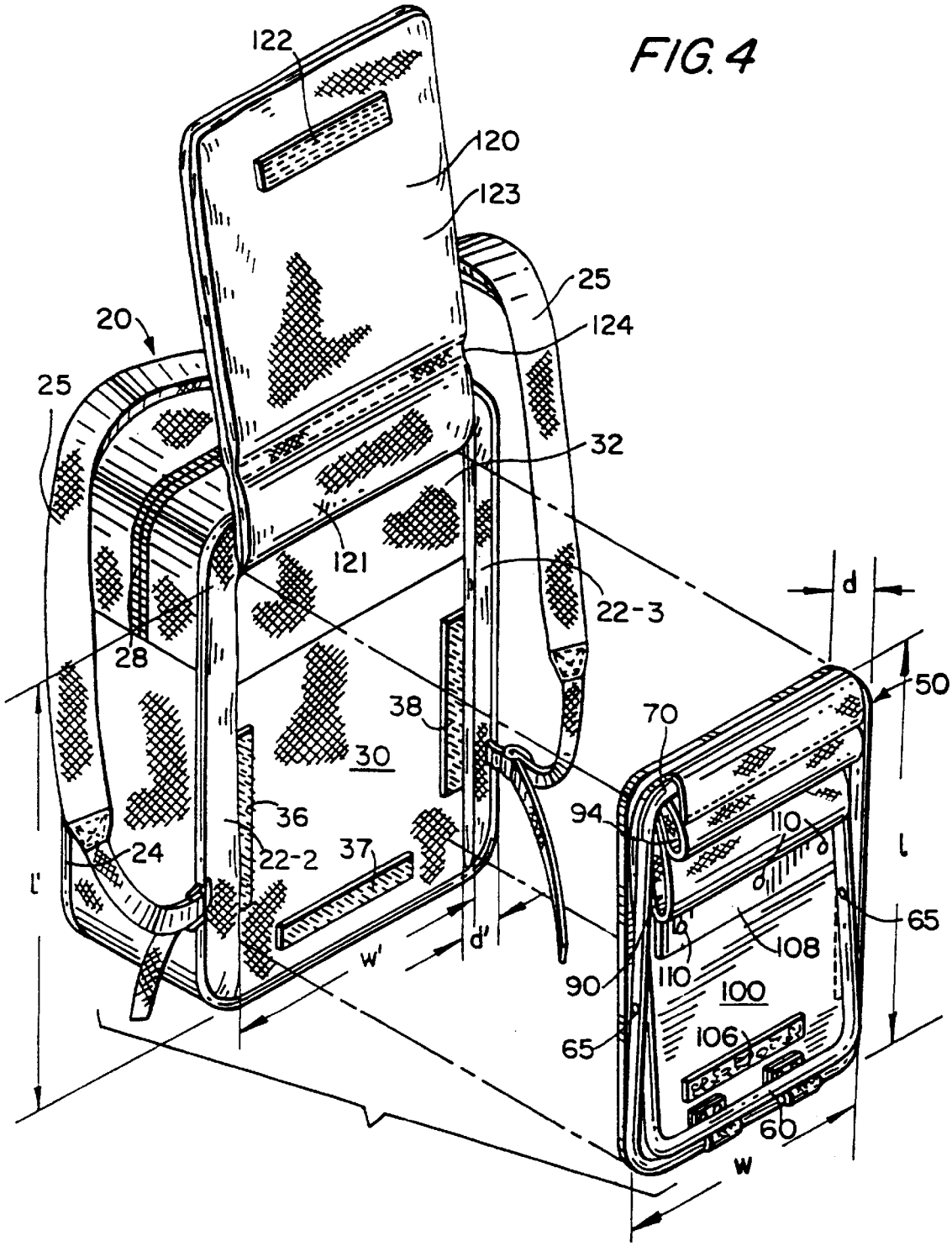
FIG. 4 is an exploded perspective view showing the manner in which the seat unit, when it is in storage condition, is intended to be placed within the auxiliary compartment of the backpack unit.

Referring now additionally to FIGS. 2–4, the rear wall 22, includes side segments 22-2 and 22-3 and upper segment 22-1, to provide an auxiliary compartment 30 therebetween. The auxiliary compartment spans a substantial portion of the length and width of the rear wall. The auxiliary compartment is recessed from the rearmost extent of the backpack by an amount d' (see FIG. 4) towards the front wall by a depth which is substantially less than the depth of the article receiving compartment 26. A separator wall 32 at the recessed inward extent of the auxiliary compartment 30 separates the auxiliary compartment 30 from the article receiving compartment 26.

Figure 6:
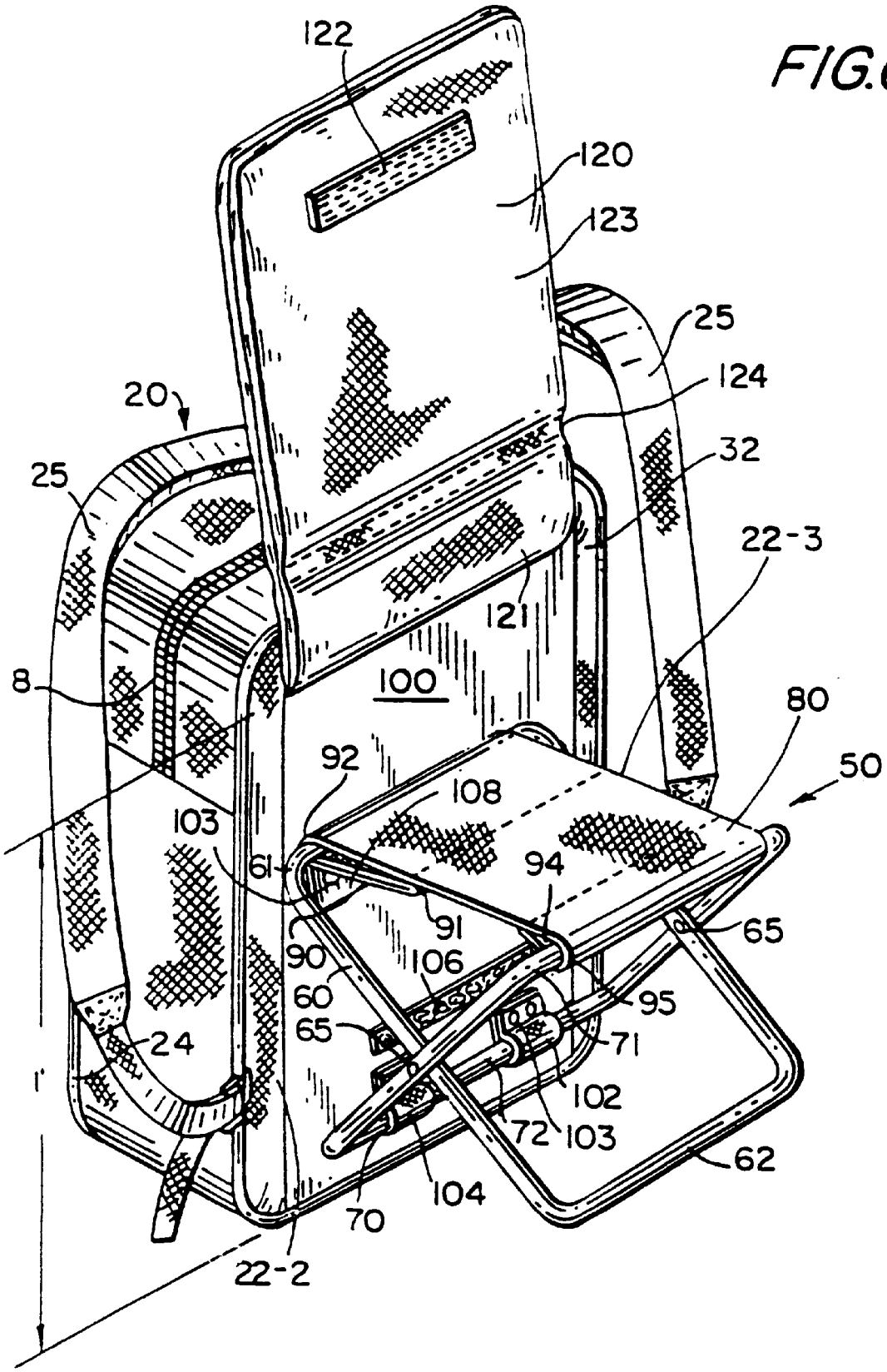
FIG. 6 is a perspective view showing the seat unit in its first operative position while it is still connected to the auxiliary compartment.

The auxiliary compartment 30 includes spaced releasable means (36, 37, 38) which may be Velcro hook and loop pressure sensitive fastening elements, for a purpose which will subsequently be explained in conjunction with the containment within the auxiliary compartment 30 of the seat unit assembly 50. In order to provide access to and coverage of the auxiliary compartment 30, a cushioned panel 120 is shown pivotally connected to the upper portion of the back wall. The cushioned panel 120 may preferably include separate sections 121, 123, which are connected at 124, in order to facilitate the cushioned panel overlying the seating platform of the seat unit when the seat unit is opened while it is still connected to the auxiliary compartment, as shown in FIG. 6.

Panel 120 includes cushioning material 125, which may typically be foam. Similarly the rear wall segments 22-1, 22-2, 22-3 include foam cushioning material 23. It should be readily appreciated that other cushioning materials may be utilized. The panel 120 also includes a releasable closure strip 122 for retaining same in the closed position, as will subsequently be explained.

Figure 5:
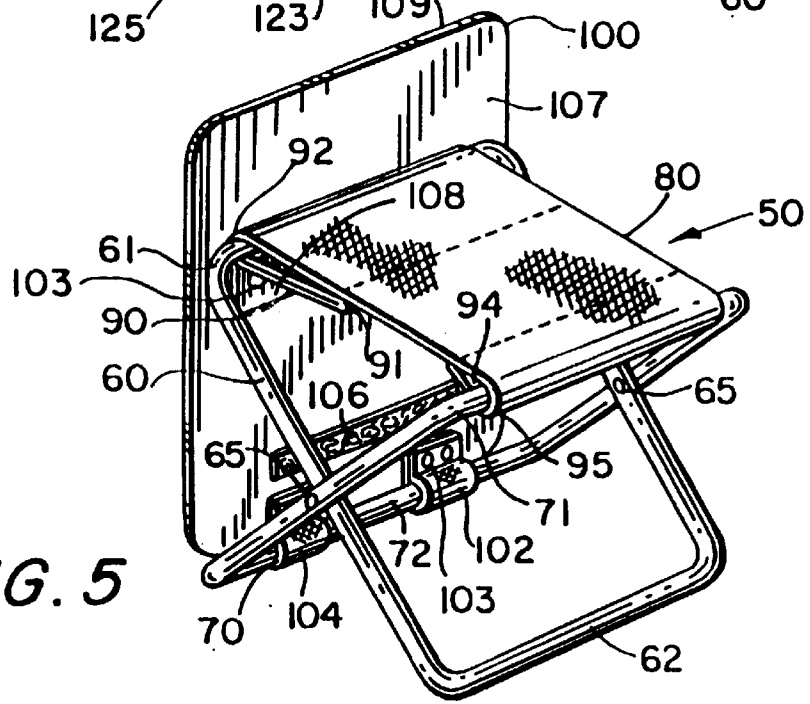
FIG. 5 is a perspective view showing the seat unit, separated from the backpack unit, and in its operative seating condition.

Referring to FIG. 5, the seat unit 50 is formed of three principal members. They are, tubular rectangularly shaped, and pivotally connected, legs 60, 70 and flexible seat 80. Additionally, the seat assembly is preferably connected to a planar storage support member 100 which, as will be subsequently discussed, is configured in association with the auxiliary compartment 30 for retaining the seat unit 50 within storage compartment 30.

The legs 60 and 70 include upper arms, or bight portions 61, 71 and opposed lower legs 62, 72. Legs 60, 70 are pivoted together at their midsection 65 so as to move between the operative condition shown in FIG. 5, and storage condition shown in FIGS. 2–4. The seat section 80 includes opposed downward ends which form pockets 90, 94 for containing the upper leg bight portions 61, 71. Pocket 90 is significantly longer than pocket 94. When the seat is in the storage position, such that the legs 60, 70 are in a nested coplanar condition (see FIG. 4) the leg bight portion 61 will be located against pocket end 91. Conversely when the seat unit 50 is removed from the auxiliary compartment 30 and moved to the operative condition, the upper leg bight portion 61 will bear against end 92 of the pocket 90 (FIG. 5). Hence, the extent of pocket 90 controls the degree to which legs 60, 70 may pivot with respect to each other. In this condition, upper leg bight portion 71 will bear against end 95 of pocket 94.

A planar storage member 100, which may typically be formed of reinforced cardboard, is preferably connected to the seat unit as follows: leg section 72 is connected to one end of planar member 100 by fabric loops 102, 104 with rivet fasteners 103. A portion 108 of the flexible seat 80 extending beyond end 92 of pocket 90 is similarly connected to planar member 100 with rivet fasteners 103. Accordingly, when the seat unit is in its collapsed condition (see FIG. 4) the legs 60, 70 and seat section 80 will be in generally coplanar relationship against surface 107 of the planar storage support member 100. It should be noted that the length (l) and width (w) of the seat unit, when it is in its storage condition, closely correspond to the length and width of planar member 100. Likewise the length (l') and width (w') of the auxiliary compartment 30 generally corresponds thereto, with the depth (d') of the auxiliary compartment being generally in the order of the depth (d) of the seat unit assembly 50 in its collapsed condition as shown in FIG. 4. In a preferred embodiment of the backpack unit, the dimensions of the auxiliary compartment are l'=13 inches, w'=10 inches and d'=1 inch.

Surface 107 of the planar support member 100 includes a releasable closure member 106 which, when the assembly 50 is placed within the auxiliary compartment 30 will generally overlie releasable member 37 of the auxiliary compartment 30. The opposed surface 109 of the planar support member 100 includes releasable members 86, 87, 88 which will engage releasable members 36, 37 and 38 when the assembly 50 is located within the auxiliary compartment 30. Accordingly when the assembly 50 is placed within the auxiliary compartment 30 the engagement of 36-86, 37-87, 38-88 will retain the seat unit assembly 50 within the auxiliary compartment 30. Further the cushioned panel 120 is then moved downward with engagement of releasable member 122, 106 retaining the panel 120 in its closed condition. The various releasable members (36, 37, 38, 86, 87, 88, 106 and 122) are typically shown as Velcro closures, with one of the complementary members including hooks and the other one including loops. It should however be understood that other types of releasable closure means, such as snaps, might also be employed. Also, the planar supporting member 100 may be deleted and alternative means provided within the auxiliary compartment (e.g. straps) to maintain the collapsed seat unit therein (see FIG. 6).

When it is desired to remove the seat unit assembly 50, the engagement of 106-122 is manually defeated, moving the cushioned panel 120 upward, with the seat unit assembly 50 being removed by manually defeating the releasable engagement of 36-86, 37-87 and 38-88. With the seat unit assembly 50 removed from the auxiliary compartment 30, the cushioned panel 120 is then moved downward with the engagement of releasable members 122 and 37 containing the cushioned panel in its closed condition.

Alternatively, as shown in FIG. 6, the seat unit 50 may be opened when cushioned panel is moved upward, and the seat unit 50 utilized while it is connected to the backpack unit 20. The cushioned panel 120 will then be pivoted downward, such that portion 123 covers the flexible seat 80, and portion 121 will cover the area of the auxiliary compartment immediately above the flexible seat 80.

Reference is now made to FIGS. 7–11 which show a second embodiment of my invention in which the seat unit is incorporated within a duffle bag 130. Components corresponding to like components of FIGS. 1–6 include the same numerical designation with the –1 suffix. The combination duffle bag and seat unit 130 include front wall 132, rear wall 136, and end walls 134, 138 An auxiliary compartment 130-1 is shown located along end wall 134. Auxiliary compartment 30-1 generally corresponds in size and functioning to previously described compartment 30 of the embodiment shown in FIGS. 1–6. The auxiliary compartment 30-1 is configured to releasably hold seat unit 50-1, which generally corresponds to seat unit 50 of the embodiments 1–6. The auxiliary component 30-1 is accessed by exterior panel 120-1 which will preferably be cushioned by foam material 125-1 to overlay the seat 80-1 when the seat is in its open condition and still retained within the auxiliary compartment as shown in FIG. 10. Alternatively, the seat may be completely removed from the duffle bag 130 (not shown) and utilized in the same general manner as shown in FIG. 5 of the prior embodiment.

The duffle bag unit 130 preferably includes top 133 having a zipper 150 to provide access to its interior. If desired, an additional exterior compartment can be accessed by zipper 152. The rear side 136 may similarly include an exterior compartment (not shown). Straps 140, 142 are provided for hand carrying of the duffle bag assembly 130. Alternatively, strap 154, connected by releasable means 156, 158 may be utilized when it is desired to carry the assembly over the user's shoulder. Alternatively, wheels (not shown) may be provided along the bottom wall of the duffle bag unit 130 such that the unit may be pulled either by the additional handle 155, or by releasing strap 154 at 156.

Figure 7:
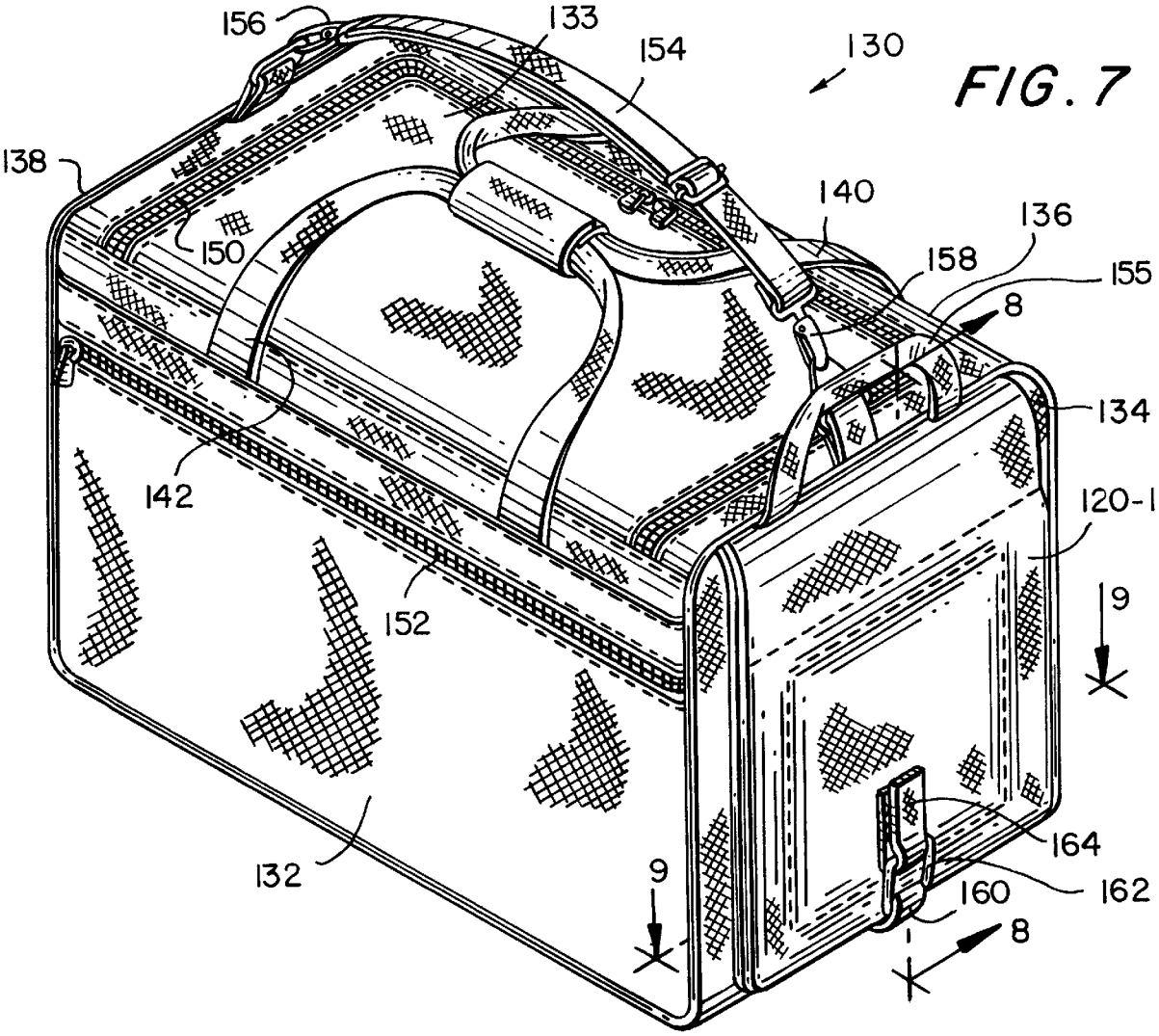
FIG. 7 is a perspective view showing the manner in which the seat unit may be utilized in combination with a duffle bag.
Figure 8:
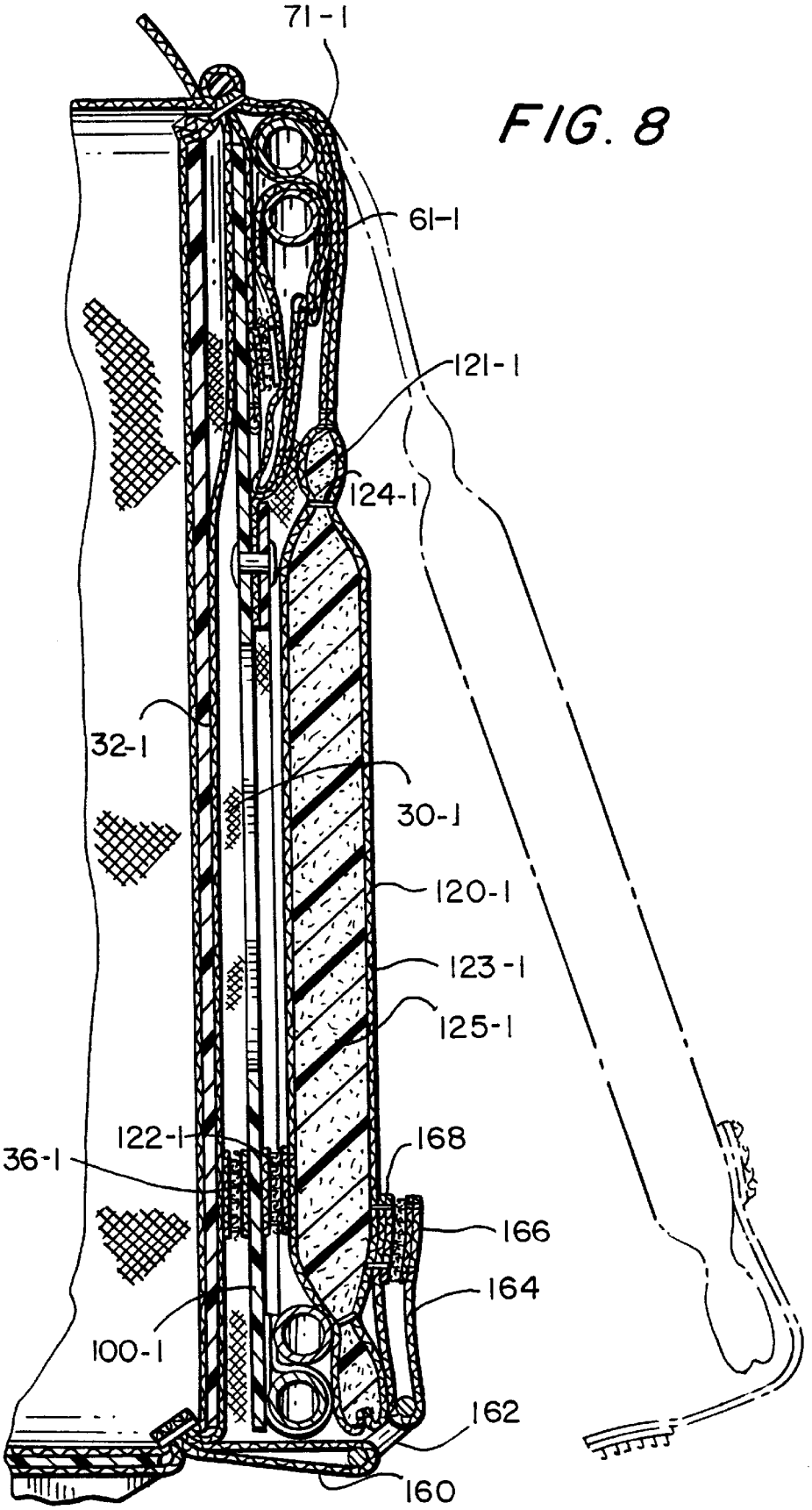
FIG. 8 is a partial cross-sectional view of the line 8—8 as shown in FIG. 7 and looking in the direction of the arrows, with the open condition of the auxiliary compartment shown diagrammatically (handle not shown for clarity).
Figure 9:
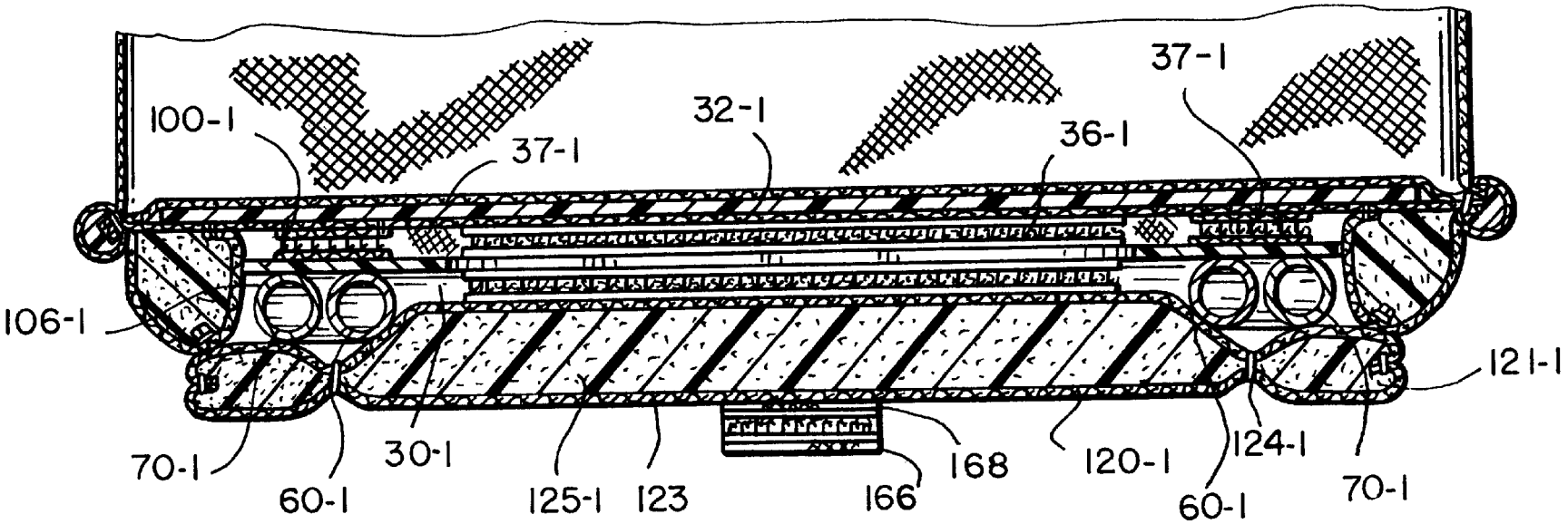
FIG. 9 is a partial cross-sectional view along the line 9—9 as shown in FIG. 7 and looking in the direction of the arrows.

When the seat unit 50-1 is retained within its auxiliary compartment 130-1, as shown in FIG. 9, the outer panel 120-1 is maintained closed by tension strap member 164 placed along the lower surface of the exterior of panel 120-1. Strap member 164 is then passed through loop 162 secured to the end of an additional strap 160 connected to the lower edge of side 134. Cooperating hook and loop Velcro fasteners 170, 172 are provided at the two ends 166, 168 of closure strap 164 for maintaining the exterior panel 120-1 in the closed condition, as shown in FIG. 7.

Figure 12:
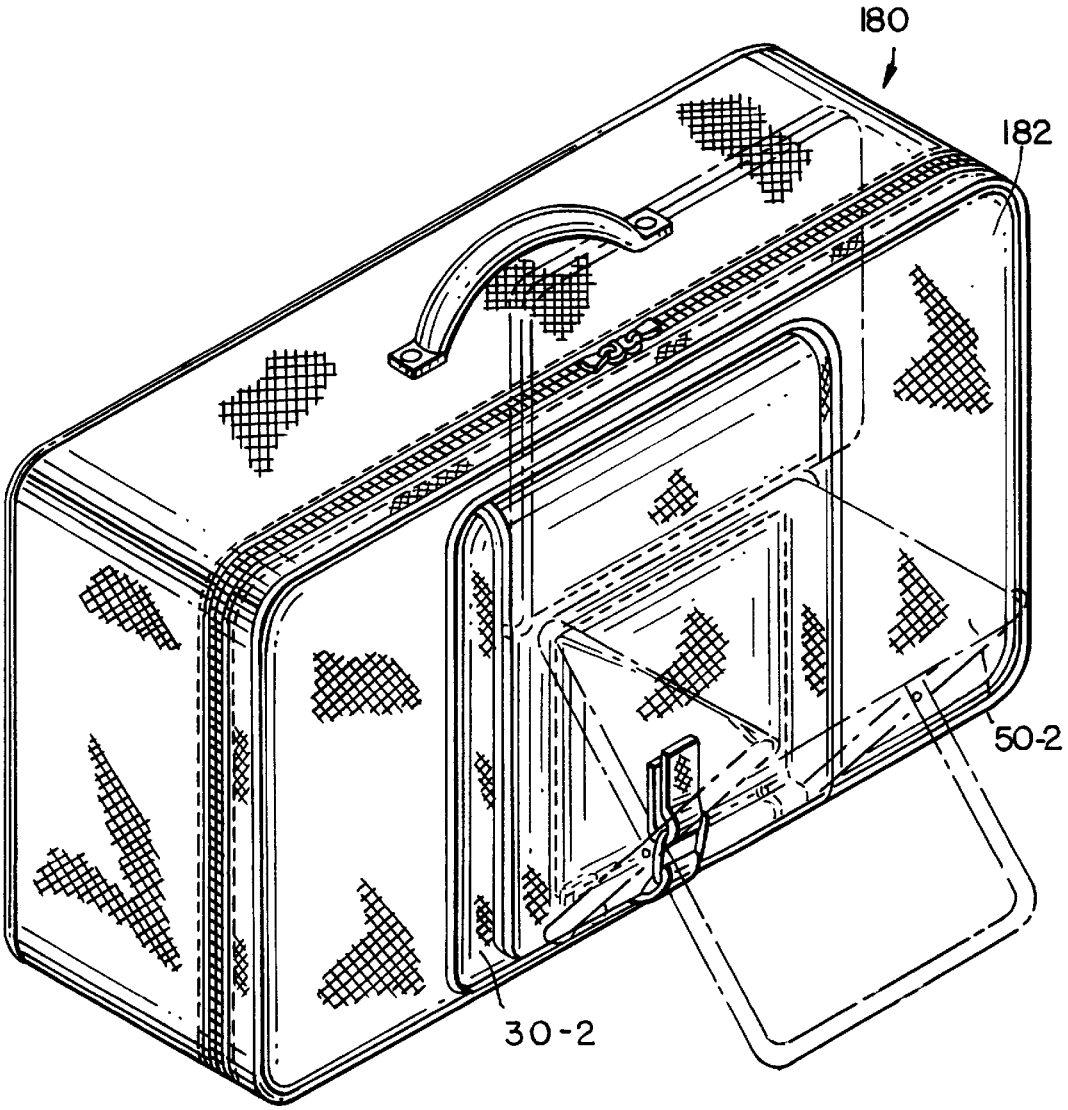
FIG. 12 is a perspective view showing another embodiment of the present invention in which the seat unit may be provided in conjunction with a suitcase, with the opened seat unit being shown diagrammatically.

Reference is now made to FIG. 12 which shows another embodiment of my invention in which the seat unit 50-2, shown diagrammatically, is located within an auxiliary compartment 30-2 shown along the front wall 182 of the suitcase unit 180. Seat unit 50-2 and auxiliary compartment 30-2 generally correspond to the comparable components shown in the aforementioned embodiments. It should naturally be understood that depending upon the dimensions, configurations, and access openings of the suitcase, the auxiliary compartment 30-2 may be located along another wall.

Although the present invention is shown in conjunction with a backpack, duffle bag, and suitcase, it should naturally be understood that it may be incorporated in other articles of luggage. Thus, while preferred embodiments of the present invention have been described in detail, various modifications, alterations, and changes may be made without departing from the spirit and scope of the present invention as defined in the following claims.

I claim:

1. A combination article of luggage and separable seat, comprising:

an article of luggage having a plurality of walls to define an article receiving compartment therebetween;

a manually openable means for providing access to said article receiving compartment and closing same;

one of said walls including an auxiliary compartment which is inwardly recessed from its outermost extent, towards said article receiving compartment by a depth which is substantially less than the depth of said article receiving compartment, such that said auxiliary compartment is externally accessible from said one wall;

a separator wall at the recessed inward extent of said auxiliary compartment for separating said auxiliary compartment from said article receiving compartment;

a seat unit including:

first and second leg members pivotally connected to each other, each of said leg members including upper and lower ends;

a flexible seat connected to the upper ends of said first and second leg members;

said seat unit manually movable between a first operative condition and a second storage condition;

said first operative condition characterized as said leg members pivoted open to separate both the upper and lower ends of the leg members in respective spaced coplanar relationship, with said flexible seat spanning between said separated upper ends, and being maintained in a taut condition, and said separated lower ends adapted to engage a support surface;

said second storage condition characterized as said leg members pivoted closed to a nested flat configuration with both of said leg members, including their upper and lower ends, lying substantially in the same plane, with said flexible seat being adapted to be flexibly contained in the same plane, whereby the seat unit is compactly folded into a planar assembly, said planar assembly substantially corresponding to the depth of said auxiliary compartment;

first and second complementary releasable means, said first releasable means within said auxiliary compartment, and said second releasable means carried by said seat unit;

said first and second releasable means maintaining said seat unit in said auxiliary compartment when said seat unit is in said second storage condition, and said first and second releasable means permitting manual removal of said seat unit from said auxiliary compartment, whereby said seat unit is selectively manually movable to said first operative condition independent of securement to said auxiliary compartment.

2. A combination article of luggage and separable seat of claim 1 wherein:

each of said leg members rectangularly shaped, and including opposed upper and lower leg sections, and opposed side leg sections, said side leg sections of one said leg member pivotally connected to respective leg sections of the other leg member at their mid section;

said upper leg sections connected to opposed ends of said flexible seat, and said lower leg sections adapted to rest on a support surface when said seat unit is in its first operative condition;

said upper leg sections disposed in a generally first horizontal plane when said seat unit is in said first operative condition with the separation between said upper leg sections in said first horizontal plane and the extent of pivotal movement between said side leg sections determined by the expanse of said flexible seat between its opposed ends connected to said upper leg sections; and when said seat section is in said first operative condition, said lower leg sections, disposed in a second generally horizontal plane, vertically displaced downward from said first horizontal plane, with the separation between said lower leg sections within said second horizontal plane generally corresponding to the separation between said upper leg sections in said first horizontal plane.

3. A combination article of luggage and separable seat of claim 1, wherein:

said seat unit when in said second storage condition forming a generally rectangular volume having a length l, width w and depth d;

said auxiliary compartment having a length l', width w' and recess d', and l', w' and d', generally corresponding to l, w and d, respectively, whereby said seat unit, when in said second storage condition is snugly contained within said auxiliary compartment.

4. A combination article of luggage and separable seat of claim 1, wherein:

said first and second releasable means are formed of complementary hook and loop elements, the hook elements carried by one of said auxiliary compartment or seat unit, and the loop elements carried by the other of said auxiliary compartment or seat unit.

5. A combination article of luggage and separable seat of claim 2, wherein:

said flexible seat including downwardly turned first and second pockets at its opposed ends, the upper leg section of a first of said leg members contained within said first pocket, and the upper leg section of a second of said leg members contained within said second pocket, said second pocket being significantly longer then said first pocket; the longitudinal extent of said second pocket corresponding to the desired movement of the upper leg section of said first leg member, as said seat unit is moved between its first and second conditions, whereby the length of said second pocket controls the extent of pivotal movement from said second storage condition to said first operative condition.

6. A combination article of luggage and separable seat of claim 2, wherein:

said seat unit further including a rectangularly shaped planar storage support member, having forward and rear surfaces, the forward surface connected, at its opposite ends to the upper leg section of one of said leg members and the lower leg section of the other of said leg members, the area of said planar support storage member closely corresponding to the planar extent of said leg members when pivotally closed to their second storage condition, whereby said leg members and seat unit are compactly folded against said forward surface, when said seat unit is in its storage condition, and said second releasable means is secured to the rear surface of said planar storage support member.

7. A combination article of luggage and separable seat of claim 1, wherein:

said article of luggage includes an outer panel pivotally connected to said one wall and said auxiliary compartment;

said outer panel overlying said seat unit when inserted in said auxiliary compartment in its storage condition, and pivotable open for removal of said seat unit from said auxiliary compartment.

8. A combination article of luggage and separable seat of claim 7;

further including supplemental releasable means for maintaining said outer panel in overlying relationship to said auxiliary compartment.

9. A combination article of luggage and separable seat of claim 8, wherein said supplemental releasable means including a first releasable member on said outer panel, a second releasable member in said auxiliary compartment and a third releasable member on said seat unit, said first releasable member engaging said second releasable member when said seat unit is removed from said auxiliary compartment, and said first releasable member engaging said third releasable member when said seat unit is in its storage condition and inserted within said auxiliary compartment.

10. An article of luggage and separable seat of claim 9, wherein:

said seat unit when in said second storage condition forming a generally rectangular volume having a length l, width w and depth d;

said auxiliary compartment having a length l', width w' and recess d', and l', w' and d', generally corresponding to l, w and d, respectively, whereby said seat unit, when in said second storage condition is snugly contained within said auxiliary compartment;

said seat unit further including a rectangularly shaped planar storage support member, having forward and rear surfaces, the forward surface connected, at its opposite ends to the an upper leg section of one of said leg members and a lower leg section of the other of said leg members, the area of said planar support storage member closely corresponding to the planar extent of said leg members when pivotally closed to their second storage condition, whereby said leg members are compactly folded against said forward surface, when said seat unit is in its storage condition;

said second releasable means is secured to the rear surface of said planar storage support member; and said second releasable member is located within said auxiliary compartment and is provided by said first releasable means, and said third releasable member is secured to the forward surface of said planar storage support member.

11. A combination article of luggage and separable seat of claim 10, wherein all of said releasable means and releasable members are formed of hook and loop elements.

12. A combination article of luggage and separable seat of claim 3, wherein l' is in the order of 13 inches, w' is in the order of 10 inches and d' is in the order of 1 inch.

13. A combination duffle bag and separable seat comprising:

a duffle bag having a pair of spaced end walls and connecting walls between said end walls to define an article receiving compartment therebetween, an openable closure means within said connecting walls to provide access to said article receiving compartment, and strap means extending from said duffle bag for manual grasping;

one of said end walls including an auxiliary compartment, which spans a substantial portion of the width and length of said one end wall, and is recessed towards said article receiving compartment, the depth of said auxiliary compartment being substantially less than the depth of said article receiving compartment;

a collapsible seat:

said auxiliary compartment adapted to releasably receive said collapsible seat;

said collapsible seat including a pair of pivoted legs and a flexible seat, each of said legs formed of rectangularly bent tubular members, having an upper bight portion, a lower bight portion, and intermediate arms;

said flexible seat including downwardly turned ends to define a first loop forming pocket at a first end of said flexible seat, and a second loop forming pocket at the opposed second end of said seat, said second pocket being significantly longer than said first pocket, and including an outer end at the said seat second end and an inward end inward of said seat second end;

the upper bight portion of a first of said legs located within said first pocket, and the upper bight portion of a second of said legs located within said second pocket;

said legs being pivotally movable between a first operative condition, and a second storage condition;

said first operative condition characterized as said legs being pivotally open with said second bight portion being at said outer end of said second pocket;

said upper bight portions tensioning said flexible seat to maintain said flexible seat in a generally horizontal taut condition, and said lower bight portions adapted to engage a generally horizontal support surface vertically displaced downward from said flexible seat;

said second storage condition characterized as said legs being pivoted to a nested flat configuration, with one of said upper bight portions, overlying the other upper bight portion, said second bight portion being at the inward end of said second pocket, and said flexible seat being collapsed and depending towards said lower bight portions, with said lower bight portions overlying each other, and said first and second legs being in coplanar relationship;

a first releasable means within said auxiliary compartment and complementary second releasable means secured to said collapsible seat for engaging said first releasable means, for storing said collapsible seat in said auxiliary compartment when said collapsible seat is in said second storage condition, whereby:

said first releasable means selectively being disengaged from said second releasable means to completely remove said collapsible seat from said auxiliary compartment prior to converting said collapsible seat to its first operative condition.

14. A combination duffle bag and separable seat of claim 13, wherein:

said collapsible seat when in said second storage condition forming a generally rectangular volume having a length l, width w and depth d;

said auxiliary compartment having a length l', width w' and recess d', and l', w' and d', generally corresponding to l, w and d, respectively, whereby said collapsible seat, when in said second storage condition is snugly contained within said auxiliary compartment.

15. A combination duffle bag and separable seat of claim 13, wherein:

said duffle bag further includes an outer panel pivotally connected to said one end wall and overlying said auxiliary compartment;

said outer panel overlying said collapsible seat when inserted in said auxiliary compartment in its storage condition, and pivotable open for removal of said collapsible seat from said auxiliary compartment.

16. A combination duffle bag and unit seat, comprising:

a duffle bag including:

a pair of spaced end walls and connecting walls between said end walls to define an article receiving compartment therebetween;

a manually openable means within said connecting walls for providing access to said article receiving compartment and closing same;

strap means extending outward of said duffle bag for manual grasping;

one of said end walls including an auxiliary compartment which spans a substantial portion of the width and length of said one end wall, and is recessed from its rearmost extent, towards said article receiving compartment by a depth which is substantially less than the depth of said article receiving compartment, such that said auxiliary compartment is externally accessible from said one end wall;

a separator wall at the recessed inward extent of said auxiliary compartment for separating said auxiliary compartment from said article receiving compartment;

a seat unit including:

first and second leg members pivotally connected to each other, each of said leg members including upper and lower ends;

a flexible seat connected to the upper ends of said first and second leg members;

said seat unit manually movable between a first operative condition and a second storage condition;

said first operative condition characterized as said leg members pivoted open to separate both the upper and lower ends of the leg members in respective spaced coplanar relationship, with said flexible seat spanning between said separated upper ends, and being maintained in a taut condition, and said separated lower ends adapted to engage a support surface;

said second storage condition characterized as said leg members pivoted closed to a nested flat configuration with both of said leg members, including their upper and lower ends, lying substantially in the same plane, with said flexible seat being adapted to be flexibly contained in the same plane, whereby the seat unit is compactly folded into a planar assembly, said planar assembly substantially corresponding to the depth of said auxiliary compartment;

securing means for maintaining said seat unit in said auxiliary compartment when said seat unit is in said second storage condition, and permitting attachment of said seat unit to said auxiliary compartment when said seat unit is in said first operative condition;

said duffle bag further including an outer panel pivotally connected to said one end wall and overlying said auxiliary compartment;

said outer panel covering said seat unit when said seat unit is inserted in said auxiliary compartment in its storage condition, and pivotable open for removal of said seat unit from said auxiliary compartment.

* * * * *